US007367477B2

(12) United States Patent
Ophardt et al.

(10) Patent No.: US 7,367,477 B2
(45) Date of Patent: May 6, 2008

(54) DISPENSER WITH SIDE MOUNTED ACTIVATION LEVERS

(75) Inventors: Heiner Ophardt, Vineland (CA); Henry Bruckner, Issum (DE)

(73) Assignee: Hygiene-Technik Inc., Beamsville, Ontario (CA)

( * ) Notice: Subject to any disclaimer, the term of this patent is extended or adjusted under 35 U.S.C. 154(b) by 448 days.

(21) Appl. No.: 11/094,597

(22) Filed: Mar. 31, 2005

(65) Prior Publication Data

US 2006/0175353 A1 Aug. 10, 2006

(30) Foreign Application Priority Data

Feb. 9, 2005 (CA) ..... 2496415

(51) Int. Cl.
*B67D 5/40* (2006.01)
*B67D 5/06* (2006.01)

(52) U.S. Cl. ..... 222/181.3; 222/321.8; 222/372

(58) Field of Classification Search ..... 222/372, 222/321.6, 321.7, 321.8, 180, 181.1, 181.2, 222/181.3
See application file for complete search history.

(56) References Cited

U.S. PATENT DOCUMENTS 4,033,487 A * 7/1977 Micallef ..... 222/207
5,154,319 A * 10/1992 Deininger et al. ..... 222/105
5,165,577 A * 11/1992 Ophardt ..... 222/181.2
D350,665 S 9/1994 Ophardt

* cited by examiner

*Primary Examiner*—Kevin Shaver
*Assistant Examiner*—Stephanie E. Tyler
(74) *Attorney, Agent, or Firm*—Riches, McKenzie & Herbert LLP

(57) ABSTRACT

A dispenser with an activation lever which extends laterally to one side of the dispenser and is particularly adapted for engagement by an elbow of one arm of a user and particularly adapted for dispensing fluid as onto the hand of a second arm of the user thereby avoiding the need for the activation lever to be engaged by a hand of a user.

19 Claims, 9 Drawing Sheets

60
10
12
14
64
63
40
39
61

DISPENSER WITH SIDE MOUNTED ACTIVATION LEVERS

SCOPE OF THE INVENTION

This invention relates to fluid dispensers and, more particularly, to lever operated dispensers for hand cleaning fluids.

BACKGROUND OF THE INVENTION

Dispensers for liquids such as for cleaning hands are known which dispensers are activated as by engaging an activation handle which extends forwardly from a dispenser and is adapted to be engaged by a user pressing downwardly on the handle. Examples of such dispensers are shown in U.S. Design Pat. D350,665, issued Sep. 20, 1994.

In the United States of America, uniform federal activation standards require that objects which project from walls as, for example, soap dispensers, must protrude no more than four inches into halls, corridors, passageways or aisles. The present applicants have appreciated disadvantages with previously known liquid dispensers that activation handles for such dispensers which are limited to merely extending no more than four inches from a wall are not easily capable for activation other than by engagement by a user's hand.

The present inventors have also appreciated the disadvantage that dispensers having a activation lever which extends forwardly from the dispenser suffer the disadvantage that they frequently do not comply with the requirement that the entirety of the dispenser protrude no more than four inches from a wall.

The present inventors have further appreciated that known liquid dispensers with forwardly extending activation levers are difficult to activate other than on engagement of a person's hand.

SUMMARY OF THE INVENTION

To at least partially overcome these disadvantages of previously known devices, the present invention provides a liquid dispenser adapted for mounting to a wall and providing an activation lever which extends to one side of the dispenser.

An object of the present invention is to provide an improved fluid dispenser having an activation lever for movement relative to the dispenser for dispensing fluid which activation lever extends laterally to one side of the dispenser and does not extend forwardly of the dispenser.

The present invention, in one aspect, provides a dispenser which provides for an activation lever which extends from either one or the other side of a dispenser or activation levers which may extend from both sides of the dispenser and each of which are operative to dispense fluid.

The present invention, in one aspect, provides a dispenser with an activation lever which extends laterally to one side of the dispenser and is particularly adapted for engagement by an elbow of one arm of a user and particularly adapted for dispensing fluid as onto the hand of a second arm of the user thereby avoiding the need for the activation lever to be engaged by a hand of a user.

In one aspect, the present invention provides a liquid dispenser having a fluid container carried by a housing, the housing including a back plate for mounting to a wall, a forward wall spaced from the back plate, a right side wall and a left side wall, with the right side wall and the left side wall joining the front wall to the back plate, an activation plate mounted within the housing for movement between an extended and a retracted position to activate a pump mechanism to dispense fluid from an outlet, an activation lever extending laterally from one of the side walls of the housing journalled to the housing for pivoting about a forwardly extending generally horizontal axis, the lever coupled to the activation plate such that movement of the activation lever moves the activation plate between a rest and an extended position to dispense fluid.

BRIEF DESCRIPTION OF THE DRAWINGS

Further aspects and advantages of this invention will be apparent from the following description taken together with the accompanying drawings in which.

DETAILED DESCRIPTION OF THE DRAWINGS

Figure 1:
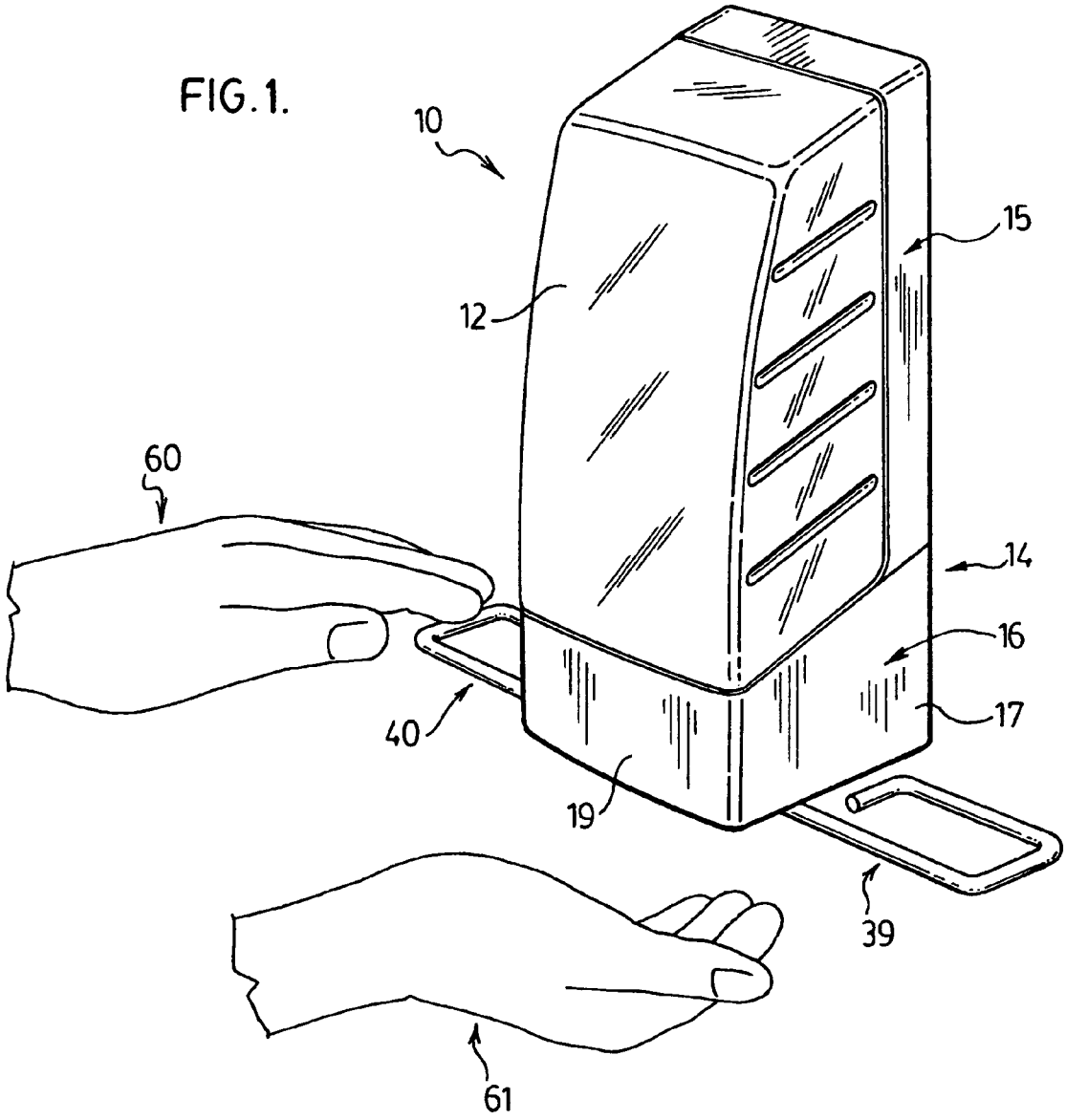
FIG. 1 illustrates a top perspective view of a soap dispenser in accordance with a preferred embodiment of the present invention shown as being used by two hands of a user.

Reference is made to FIG. 1 which shows a preferred embodiment of a dispenser 10 in accordance with the present invention. The dispenser 10 has a housing 14 to be secured to a wall 100 schematically shown in FIG. 14 as in a hallway, corridor and the like. The housing 14 includes an upper back plate portion 15 and a base portion 16. A cover 12 is removably secured to the housing as, for example, to permit removal and replacement of a disposable fluid container 101 seen only in FIGS. 5 and 7 to be received between the housing and cover. The base portion 16 of the housing 14 includes two side walls 17 and 18, a front wall 19 and a rear wall 20. As illustrated in FIGS. 4 to 7, internally within the base portion 16 a support plate 21 bridges between the side walls 17 and 18 and the front and rear walls 19 and 20 for supporting of the fluid filled container 101 thereabove. As shown in dashed lines in FIGS. 4 and 6, the container 101 has a lower open end in communication with a piston chamber forming member 103 secured to the support plate 21 against vertical movement. A vertically movable piston element 105 is disposed within and below the piston chamber forming member 103 for vertical sliding within the piston chamber forming member 103 to dispense fluid from the container 101 out of an outlet 36 from the piston element 105. An activator plate 30 is provided below the support plate 21 internally within the base portion 16. The activator plate 30 is vertically slidable on slide posts 31. Helical coil springs 32 disposed about the posts 31 and constrained between the support plate 21 and the activator plate 30 bias the activator plate 30 downwardly. The activator plate 30 has the piston element 105 coupled thereto for movement upwardly and downwardly with the activator plate 30 such that in movement in an upward and downward cycle of the activator plate 30, the piston element 105 interacts with the piston chamber forming member 103 to dispense liquid out of the outlet 36 of the piston member 103.

Figure 2:
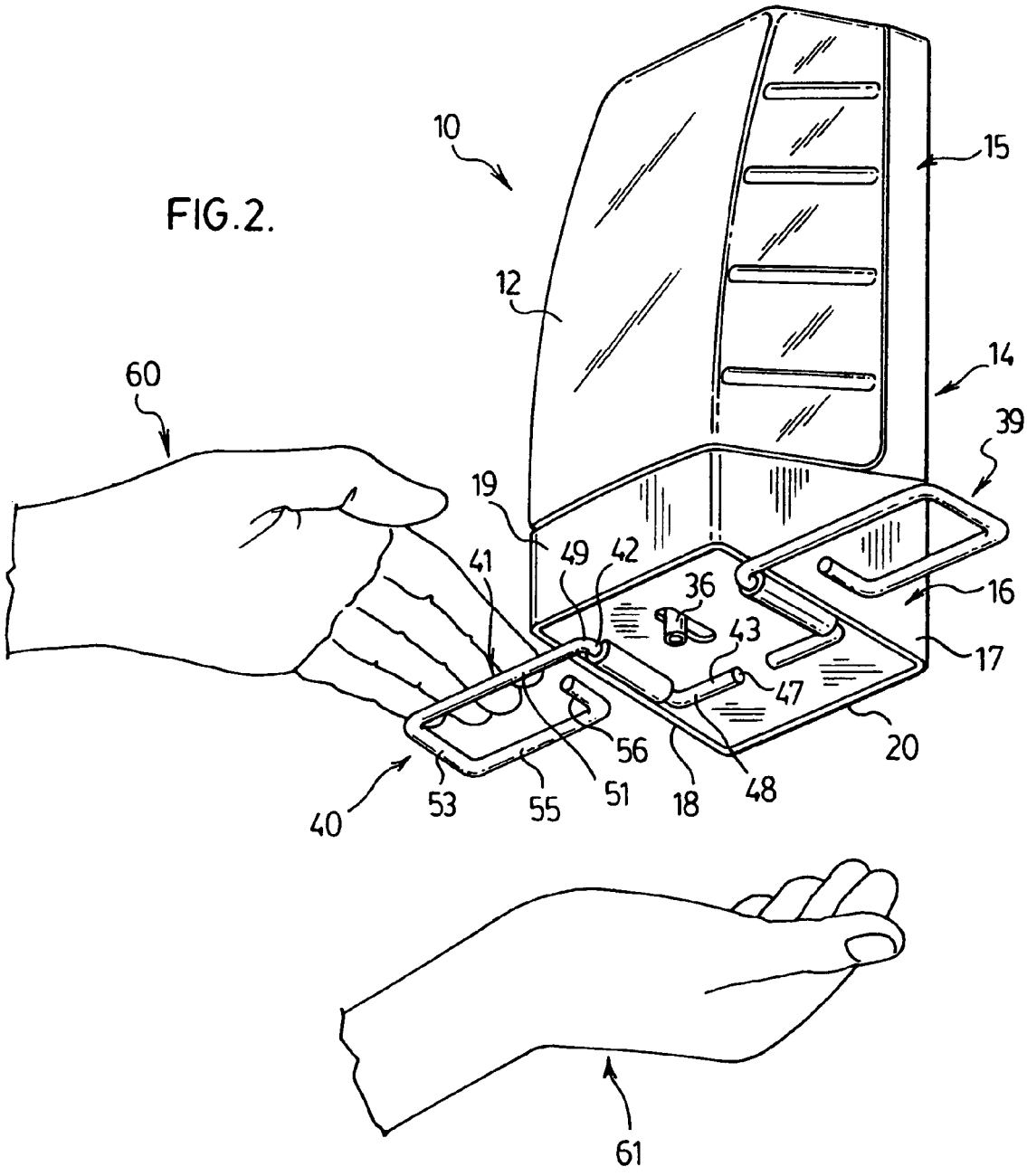
FIG. 2 is a bottom perspective view of the dispenser and hands of FIG. 1.
Figure 5:
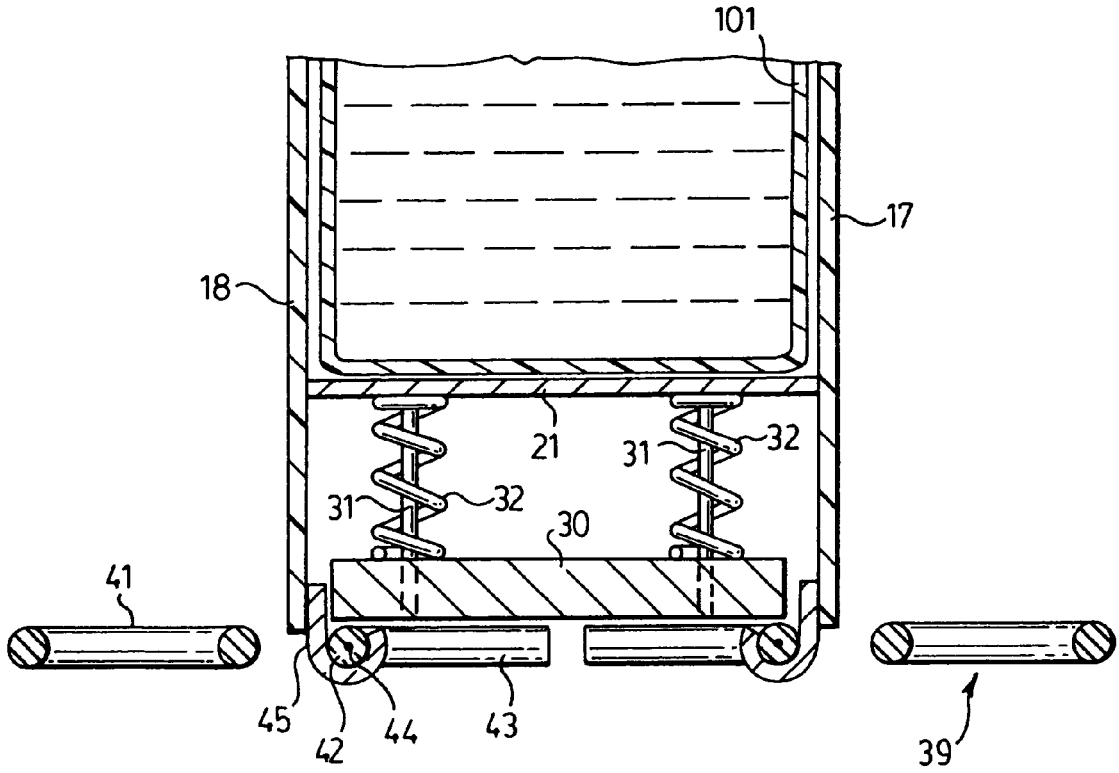
FIG. 5 is a cross-sectional view along section lines 5-5' in FIG. 4.

A left-hand side activation lever 40 as best seen in FIG. 2 is mounted to the side wall 18. The actuator lever 40 has an engagement arm 41 which extends laterally from the left-side of the dispenser 10, a pivot arm 42 and a driver arm 43. The actuator lever 40 is coupled to the side wall 18 proximate the bottom of the side wall 18 for pivoting about an axis 44 coaxially through the cylindrical pivot arm 42. In this regard, as best seen in FIG. 5, a hook shaped bracket member 45 is secured to the side wall 18 and extends downwardly therefrom presenting an upwardly opening bight-like journal way within the cylindrical pivot arm 42 is received. The driver arm 43 extends inwardly from the pivot arm 42 to underlie the activator plate 30. The activator lever 40 is illustrated as being formed from a continuous length of a cylindrical rod bent into a desired form so as to extend from an inner end 47 of the driver arm 43 to a generally right angled bend 48 where the driver arm 43 merges with the pivot arm 42. At another generally right angled bend 49, the pivot arm 42 merges with the engagement arm 41. The engagement arm 41 is illustrated as including a forward arm 51, an outer side arm 53, a rear arm 55 and an inner side arm 56 arranged in a generally rectangular shape and all lying in the same plane. In this regard, preferably, the entirety of the rod forming the actuator lever 40 is formed to lie in the same plane. The rod may preferably be a metal rod which resists retention of microbes and can be readily cleaned.

FIG. 5 illustrates a front view with a dispenser at rest with the activator plate 30 in a fully extended position with the activator plate 30 stopped from further outward sliding as, for example, by a lower surface of the activator plate 30 engaging on the upper surface of the activator lever 40 over the pivot arm 42 and the driver arm 43 with the driver arm 43 being placed in a horizontal position by reason of the springs 32 urging the activator plate 30 downwardly. On a user urging the engagement arm 41 downwardly, the activator lever 40 is pivoted about the axis 44 of its pivot arm 42 so as to pivot the driver arm 43 counterclockwise from the position seen in FIG. 5 to the position seen in FIG. 7. In so doing, the inner end 47 of the driver arm 43 moves the activator plate 30 upwardly. On release of the engagement arm 41 by a user, the springs 32 biasing the activator plate 30 moves the activator plate 30 and the activator lever 40 back to the rest position shown in FIG. 5.

The activator lever 40 may easily be removed from engagement with the housing 14. With the activator plate 30 manually held a retracted position as, for example, shown in FIGS. 6 and 7, the activator lever 40 may be manipulated such that its pivot arm 42 is raised above and then laterally to the side or forwardly relative to the bracket member 45 so as to disengage the pivot arm 42 from the bracket 45 and, hence, remove the activator lever 40. Removal of the activator lever 40 is of assistance in reducing the size of the dispenser 10 for shipment and storage. The activator lever 40 is preferably sized such that it will fit within the interior of the dispenser 10 as for storage and shipment.

The dispenser as illustrated in FIGS. 1 to 7 includes not only a left hand activator lever 40 as illustrated but also a right hand activator 39 which is an identical mirror image to the activator lever 40 and operates in the same manner.

Figure 3:
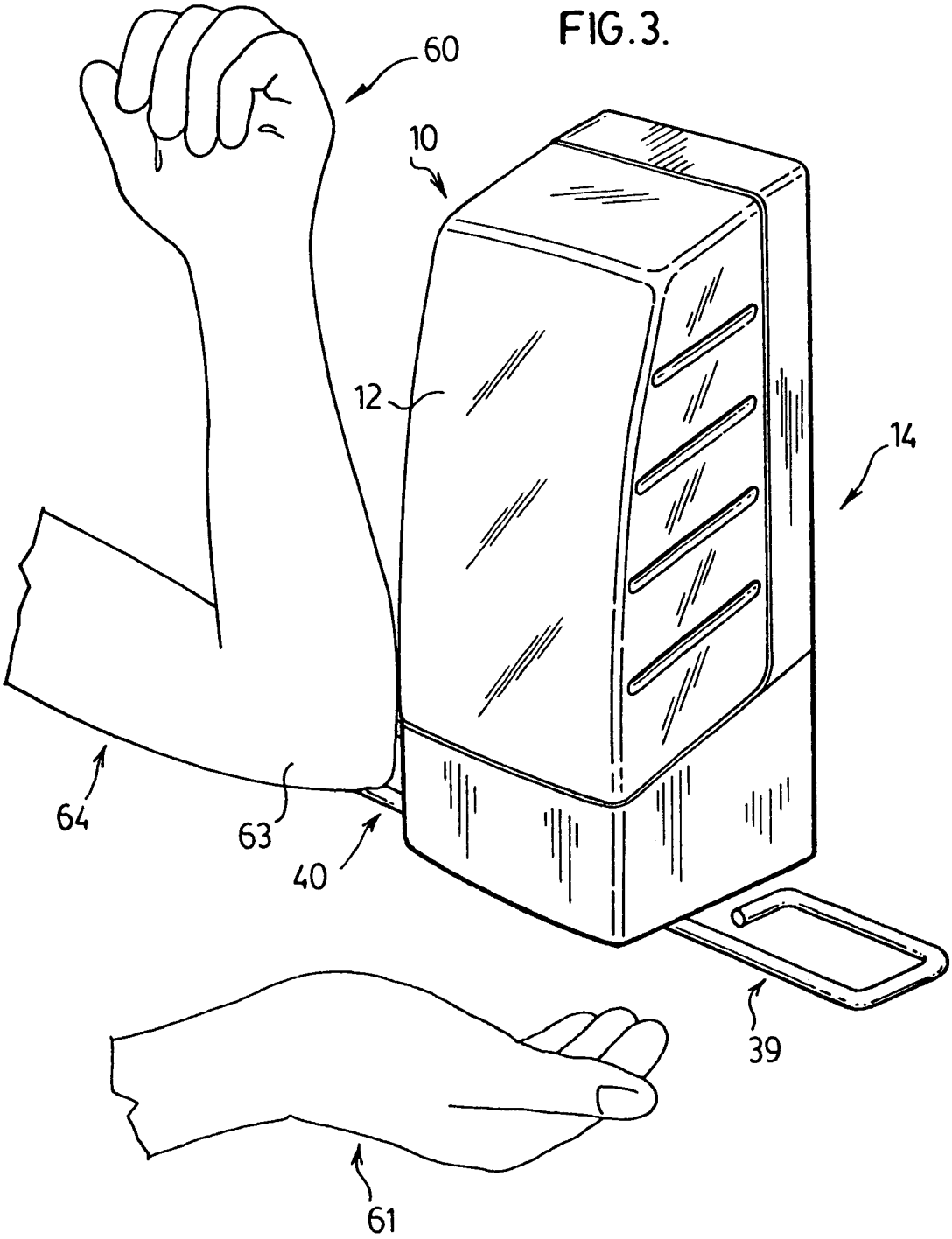
FIG. 3 is a perspective view similar to that in FIG. 1 but showing the dispenser as being activated by an elbow of a user.
Figure 4:
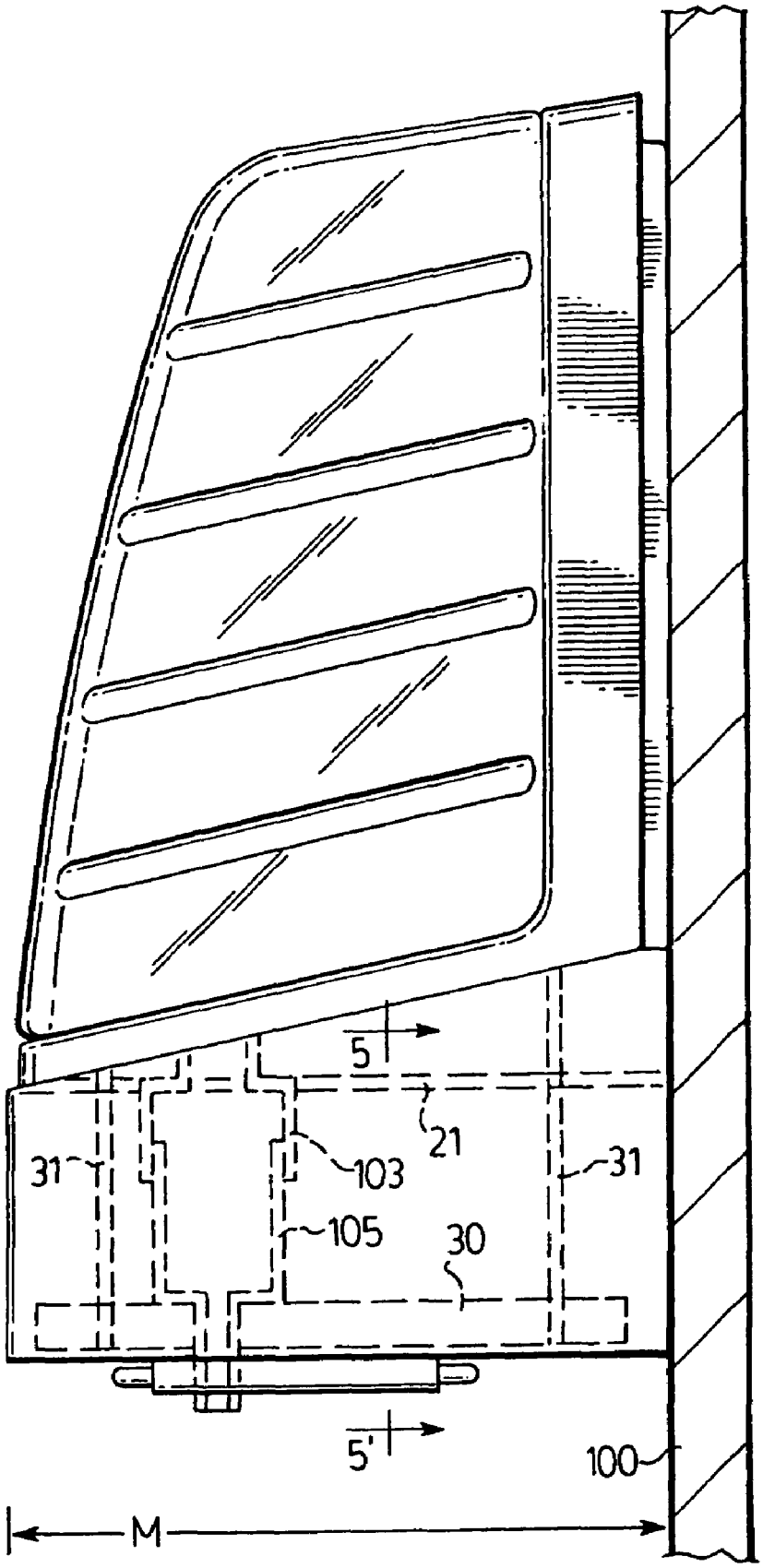
FIG. 4 is a schematic side view of the dispenser of FIG. 1.

FIGS. 1 and 2 illustrate the dispenser as being used by a user with the user's left hand 60 to engage the activator lever 40 so as to dispense fluid from the outlet 36 onto a user's right hand 61 which is held underneath the outlet 36. FIG. 3 illustrates a preferred manner of use in which the left hand actuator lever 40 is activated by engagement with the elbow 63 of a person's left arm 64 for dispensing onto a user's right hand 61. As shown, with a user's left arm 64 bent at the elbow 63, the user's elbow 63 may be brought into contact with the activator lever 40 to move the activator lever 40 to dispense fluid. This method of operation is advantageous in that it avoids contacting the activating lever 40 with a person's hand which is more likely to carry contaminates arising, for example, by earlier engagement of contaminated areas with the person's hand. The laterally extending activator lever 40 provides a convenient lever for activation by the user's elbow 63.

Figure 6:
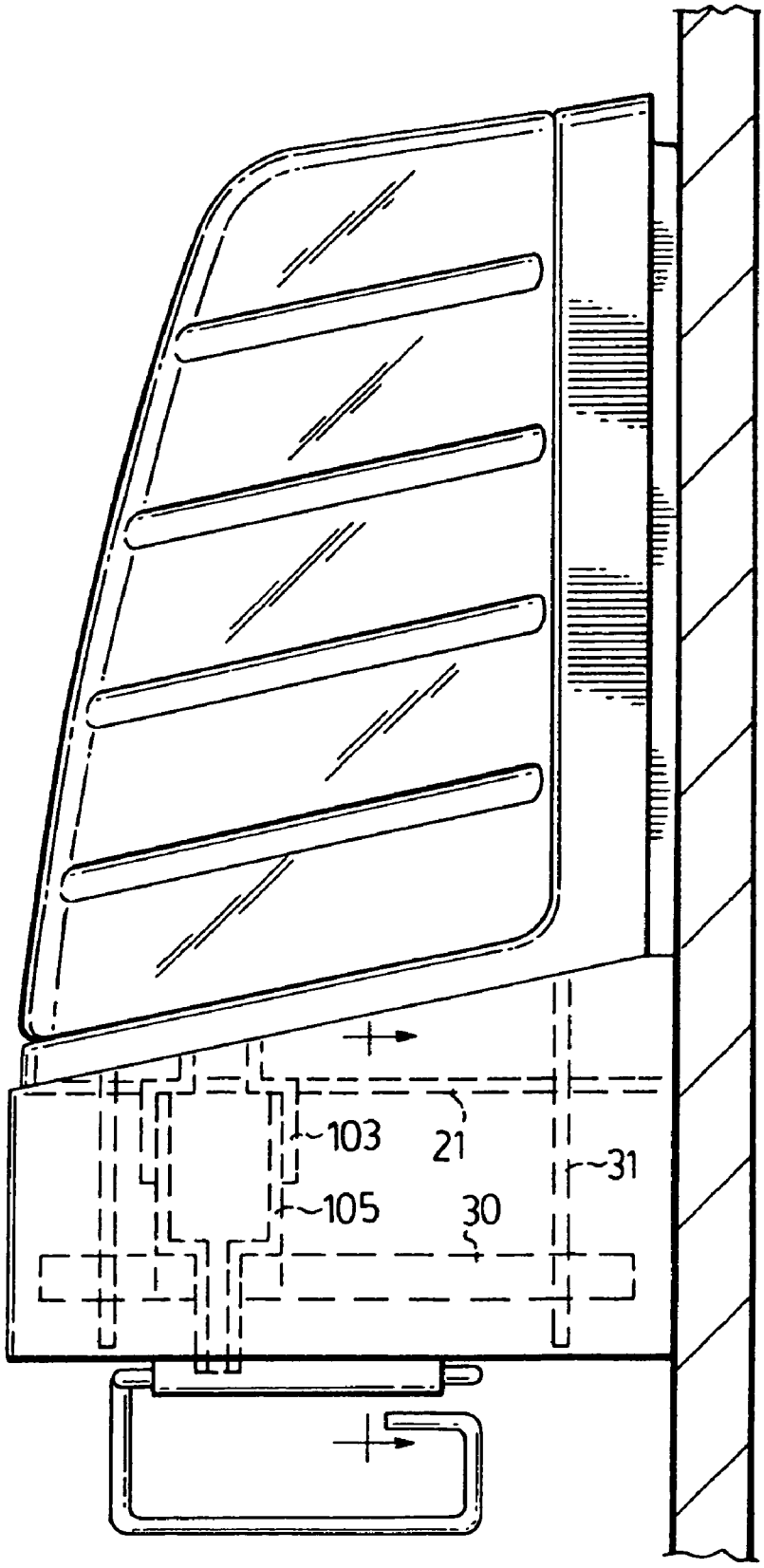
FIG. 6 is a view the same as FIG. 4, however, with the dispenser in an activated position.
Figure 7:
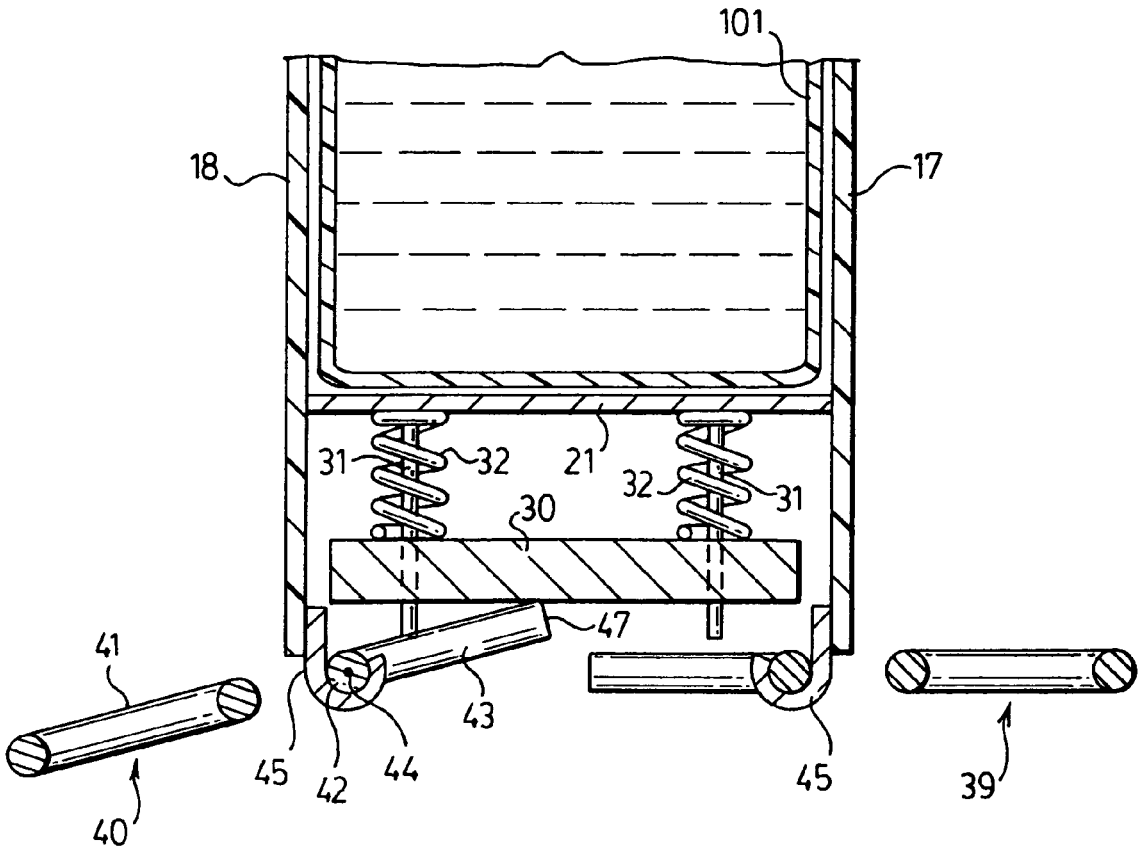
FIG. 7 is a cross-sectional view along section lines 7-7' in FIG. 6.

In accordance with the preferred embodiment, as seen in FIG. 6, the entirety of the dispenser 10 preferably extends out from the wall 100 to a minimum extent indicated as "M" as, for example, preferably to comply with requirements which requirements that the extent to which the dispenser extends forwardly be kept to a minimum as, for example, not more than about four inches. The two activator levers 39 and 40 extend laterally from the dispenser and do not extend forwardly from the wall 100 beyond the forward extent of the dispenser, in this case, beyond the front wall 19 of the base portion 16 of the housing 12 of the dispenser 10.

Figure 8:
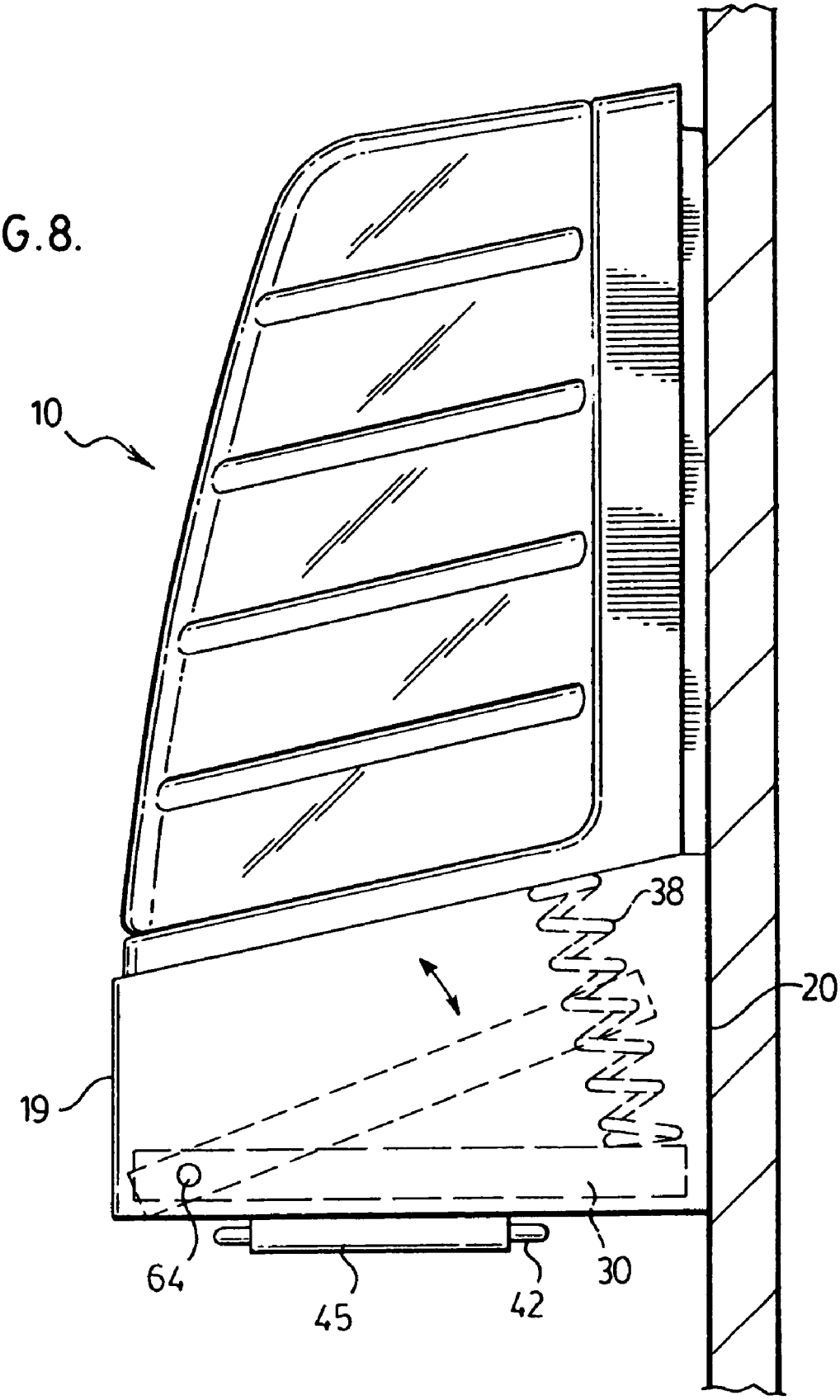
FIG. 8 is a schematic partially section side view similar to that shown in FIG. 4, however, of a dispenser in accordance with a second embodiment with an activation plate mounted for relative pivoting.

Reference is made to FIG. 8 which schematically illustrates a dispenser 10 similar to that in the first embodiment, however, in which the activator plate 30 is shown as mounted to the housing for pivoting about a horizontal axis 64 which extends side-to-side parallel to the front wall 19 and rear wall 20 and with the activator plate 30 biased for pivotal movement about the axis 64 between a position at rest shown schematically in dashed lines and a retracted position illustrated in dotted lines. A spring 32 biases the activator lever to pivot outwardly. The activator levers are to be mounted in the same manner as in the first embodiment and pivoting the activator levers 39 or 40 will pivot activator plate 30 inwardly.

Figure 9:
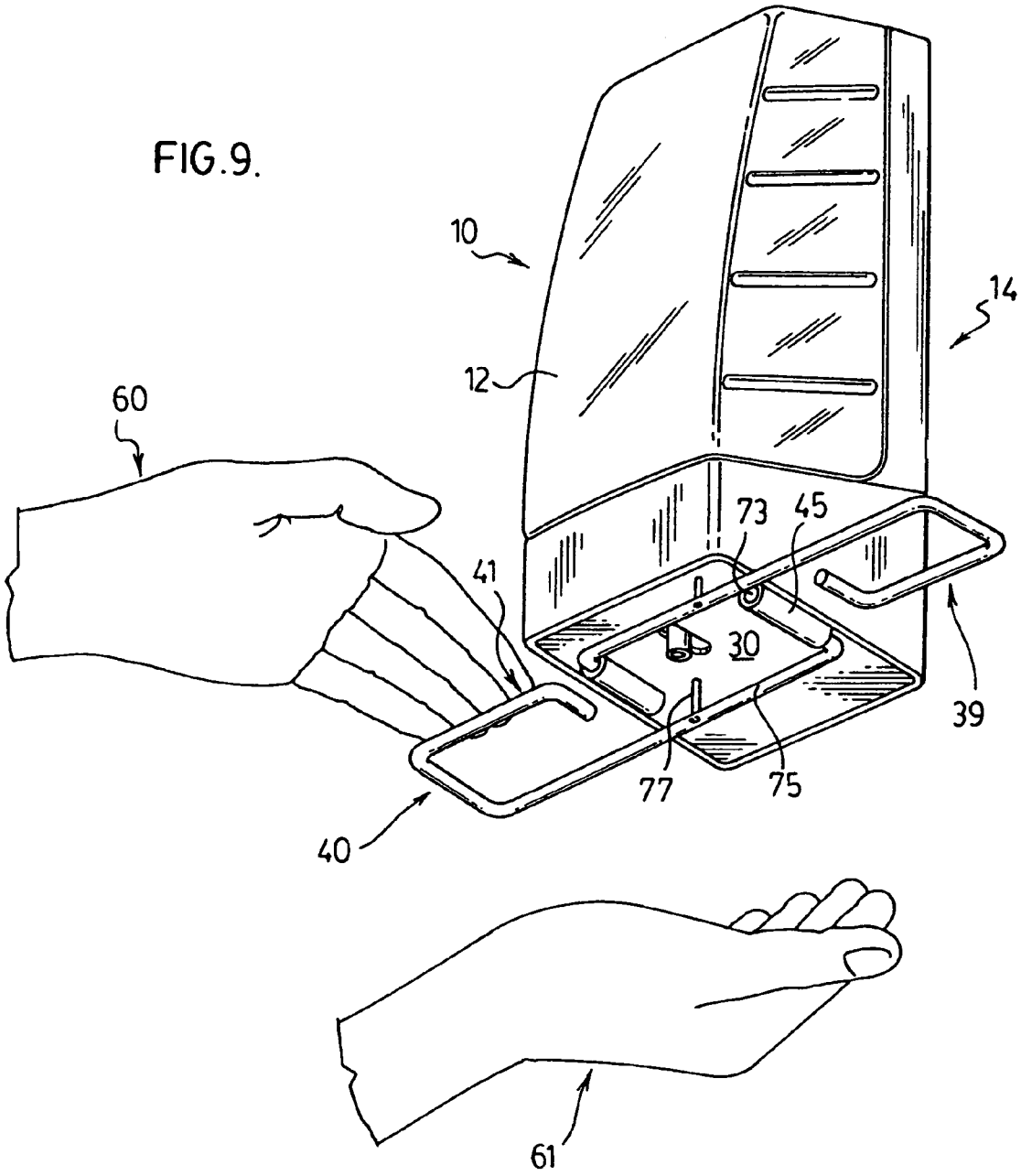
FIG. 9 is a schematic pictorial view similar to FIG. 2, however, showing a third embodiment of the invention in accordance with the present invention.

Reference is made to FIG. 9 which illustrates a third embodiment of the invention in accordance with the present invention. In the embodiment of FIG. 9, the activation lever 40 is mounted for pivoting about a pivot axis coaxially through a pivot arm 73 at one end of the activation lever 70 which is journalled in a bracket member 45 providing a journal channelway which secures the activation lever 40 to a side wall of the dispenser. Downward movement of an engagement arm portion 41 which extends laterally from the housing 12 results in the entire activator lever 40 being moved downwardly about the pivot axis through pivot arm 73. A portion of a driver arm portion 75 which is underneath the activation plate 30 is coupled to the activation plate 30 as by pin 77 such that with downward pivoting of the driver arm portion 75, the activation plate 30 is drawn downwardly. In this embodiment, the activation plate 30 or other activation mechanisms would be mounted for being drawn downwardly by the driver arm portion 75 and biased to an upwardly disposed rest position. Of course, intermediate lever or other connection mechanisms could be provided between the driver arm portion 75 and any activation mechanism to activate the pump. In the embodiment of FIG. 9, with mechanical coupling of each of the activation lever 40 to the activation plate 30 by the pin 77, movement of the left hand activation lever 40 would also result in movement of the right hand activation lever 39.

It is to be appreciated that the particular nature of the pump mechanism is not critical. While the preferred embodiment illustrates the use of an activator plate 30 moving one portion of a piston-type pump upwardly relative another portion of a piston-like pump, it is to be appreciated that the invention is not limited to the use of such activators or piston-type pumps. Various other forms of pump mechanisms such as peristaltic pumping mechanisms, simple displacement pumps and the like can be provided for activation by relative movement of the driver arm 43 on pivoting of the activator lever 40.

While the preferred embodiments illustrate the activator lever 40 as formed from a cylindrical rod, this is not necessary and an actuator lever may be formed from other materials and to have other shapes as may be advantageous, however, preferably with the activator levers 39 and/or 40 to not extend forwardly beyond the forward extent of the dispenser.

While the preferred embodiments illustrate two activator levers 39 and 40, one to extend laterally from each side of the dispenser, it is to be appreciated that merely one such activator need be required.

The activator levers 39 and 40 are shown to be mirror images of the other, such that the same activator lever can be used either on the left or the right sides as is advantageous in requiring only a single form of the activator lever be manufactured.

While the preferred embodiments merely illustrate providing the dispenser with left and right hand side activator levers 40 and 39, it is to be appreciated that, in addition, the same dispenser could be provided with a central activator lever which extends forwardly and is adapted to be engaged as by the hand of a user for movement upwardly or downwardly or generally forwardly or rearwardly to move the activator plate. Such an activator lever may be provided in addition to the lateral activator levers and provided such an activator plate does not extend forwardly beyond the front wall 19, it would meet with requirements for minimizing the extent to which the dispenser extends laterally from a wall. Providing the additional forward activator lever would provide additional alternatives to a person desiring to dispense fluid, however, generally is not expected to be necessary whenever the laterally extending activator levers 39 and 40 may be provided.

While the invention has been described with reference to preferred embodiments, many modifications and variations will now occur to persons skilled in the art. For a definition of the invention, reference is made to the accompanying claims.

We claim:

1. A liquid dispenser having a fluid container carried by a housing, the housing including a back plate for mounting the housing to a wall surface, a forward wall spaced forwardly from the back plate, a right side wall and a left side wall, the right side wall and the left side wall spaced laterally from each other with the right side wall and the left side wall joining the front wall to the back plate, an activation plate mounted within the housing for movement between an extended and a retracted position to activate a pump mechanism to dispense fluid from an outlet, an activation lever extending laterally from one side wall selected from the right side wall and left side wall, the activation lever journalled to the housing for pivoting about a forwardly extending generally horizontal axis, the activation lever coupled to the activation plate such that movement of the activation lever moves the activation plate between the extended and a retracted position to dispense fluid, wherein the activation lever is secured to one of the side walls at the bottom of the side wall with the activation lever including an engagement arm portion to extend laterally from that one side wall and with a driver arm portion of the actuation lever to extend inwardly from the side wall into engagement with the activation plate, the activation lever being journalled for pivoting about a generally horizontal axis extending forwardly substantially parallel to that one side wall, downward movement of the engagement arm portion moving the driver arm portion upwardly thereby moving the activation plate upwardly.

2. A dispenser as claimed in claim 1 wherein the activation lever is removably coupled to the housing for storage and shipment.

3. A dispenser as claimed in claim 2 wherein the activation lever is coupled to the one side wall in an upwardly open journaling channel, and with the activation lever being removable from engagement with the dispenser by manual movement of the entirety of the activation lever upwardly relative to the journaling channel.

4. A dispenser as claimed in claim 3 wherein the activation plate is biased downwardly by a spring to a position which retains the activation lever in the journaling channel against removal.

5. A dispenser as claimed in claim 4 wherein the activation lever is formed from a cylindrical rod with a pivot arm portion journalled to the housing for pivoting about the axis, with the driver arm portion extending inwardly to an inner end which engages the activation plate and with the engagement arm portion extending laterally to a side of the dispenser beyond the one side wall for engagement by a user to dispense fluid.

6. A dispenser as claimed in claim 1 wherein the engagement arm of the activation lever is adapted for engagement by an elbow of a user to dispense fluid.

7. A dispenser as claimed in claim 4 wherein the pivot arm portion extends parallel the axis and has a first end and a second end, the driver arm portion extending laterally inwardly from a first end of the pivot arm portion and the engagement arm portion extending laterally to a side of the dispenser from a second end of the pivot and portion to beyond the one side wall.

8. A dispenser as claimed in claim 7 wherein two activation levers are provided each being identical to the other, one activation lever being secured to the right side wall and the other activation lever being secured to the left side wall, and the dispenser is adapted for use in a mirror image orientation on either side of the dispenser.

9. A dispenser as claimed in claim 5 wherein the activation lever is formed with the cylindrical rod to have a central axis therethrough lie in a flat plane with the engagement arm portion forming a loop-like member disposed in the plane.

10. A dispenser as claimed in claim 9 wherein the loop-like member includes a forward portion and outside portion and a rear portion with one of the forward portion and the rear portion merging into one of the ends of the pivot and portion.

11. A dispenser as claimed in claim 2 wherein the activation lever fits internally within the housing for storage and shipment.

12. A liquid dispenser having a fluid container carried by a housing, the housing including a back wall, a forward wall spaced forwardly from the back wall, a right side wall and a left side wall, the right side wall and the left side wall spaced laterally from each other, with the right side wall and the left side wall joining the front wall to the back plate, an activation plate mounted within the housing for movement between an extended and a retracted position to activate a pump mechanism to dispense fluid from an outlet, an activation lever extending laterally from one side wall selected from the right side wall and left side wall, the activation lever journalled to the housing for pivoting about a forwardly extending generally horizontal axis, the activation lever coupled to the activation plate such that movement of the activation lever moves the activation plate between the extended and the retracted position to dispense fluid, the back wall mounted to a wall surface of a building with the dispenser extending forwardly from the wall surface from the back wall to the front wall and with the activation lever extending laterally of the dispenser in front of the wall surface.

13. A dispenser as claimed in claim 12 wherein the activation lever is secured to the one side wall at the bottom of one side wall with the activation lever including an engagement arm to extend laterally from the one side wall and with a driver arm of the actuation lever to extend inwardly from that one side wall into engagement with the activator plate, the activator lever being journalled for pivoting about a generally horizontal axis extending forwardly substantially parallel to the one side wall, downward movement of the engagement arm moving the driver arm upwardly thereby moving the activation plate upwardly.

14. A dispenser as claimed in claim 13 wherein the activation lever is removably coupled to the housing for storage and shipment.

15. A dispenser as claimed in claim 14 wherein the activation lever is coupled to the one side wall in an upwardly open journaling channel, and with the activation lever being removable from engagement with the dispenser by manual movement of the entirety of the activation lever upwardly relative to the journaling channel.

16. A dispenser as claimed in claim 15 wherein the activation plate is biased downwardly by a spring to a position which retains the activation lever in the journaling channel against removal.

17. A dispenser as claimed in claim 16 wherein the activation lever is formed from a cylindrical rod with a pivot and portion journalled to the housing for pivoting about the axis, with the driver arm portion extending inwardly to an inner end which engages the activation plate and with the engagement arm portion extending laterally of the dispenser beyond the one side wall for engagement by a user to dispense fluid.

18. A dispenser as claimed in claim 12 wherein the engagement arm of the actuator lever is adapted for engagement by an elbow of a user to dispense fluid.

19. A dispenser as claimed in claim 4 wherein the pivot arm portion extends parallel the axis and has a first end and a second end, the driver arm portion extending laterally inwardly from a first end of the pivot arm portion and the engagement arm portion extending laterally of the dispenser from a second end of the pivot arm portion to beyond the one side wall.

* * * * *